United States Patent [19]

Crisci

[11] Patent Number: 4,667,839

[45] Date of Patent: May 26, 1987

[54] SNAP ON TAMPER INDICATING CLOSURE FOR CONTAINERS

[75] Inventor: Robert E. Crisci, New Castle, Pa.

[73] Assignee: Northern Engineering and Plastics Corp., New Castle, Pa.

[21] Appl. No.: 771,675

[22] Filed: Sep. 3, 1985

[51] Int. Cl.[4] ..... B65D 41/48

[52] U.S. Cl. ..... 215/256; 215/344; 215/DIG. 1

[58] Field of Search ..... 215/256, 254, 344, DIG. 1

[56] References Cited

U.S. PATENT DOCUMENTS

| | | | |
|---|---|---|---|
| D. 221,516 | 8/1971 | Crisci . | |
| 3,504,818 | 4/1970 | Crisci . | |
| 3,812,994 | 5/1974 | Feldman | 215/256 |
| 3,893,583 | 7/1975 | McLaren | 215/256 |
| 3,907,146 | 9/1975 | Fields | 215/344 X |
| 4,037,746 | 7/1977 | Ver Hage | 215/256 X |
| 4,066,182 | 1/1978 | Allen et al. | 215/256 |
| 4,089,463 | 5/1978 | Babiol | 215/344 X |
| 4,166,552 | 9/1979 | Faulstich | 215/256 |
| 4,202,455 | 5/1980 | Faulstich | 215/256 X |

FOREIGN PATENT DOCUMENTS

| | | | |
|---|---|---|---|
| 611668 | 10/1956 | Fed. Rep. of Germany | 215/256 |

*Primary Examiner*—Donald F. Norton

*Attorney, Agent, or Firm*—Harpman & Harpman

[57] ABSTRACT

A closure for a container such as a blow molded bottle having a neck surrounding an opening therein defined by an inturned annular flange formed by a spin finish operation on the blow molded bottle, the closure having a cap portion and an annular tear skirt depending therefrom, the closure having an annular frangible wall joining the cap portion and the tear skirt and fastening configurations on the cap portion and the tear skirt, the cap portion having a resilient top portion with cross sectionally rounded annular sealing flanges depending therefrom arranged for sealing registry with the upper surface of the inturned annular flange defining the opening in the bottle.

6 Claims, 8 Drawing Figures

SNAP ON TAMPER INDICATING CLOSURE FOR CONTAINERS

BACKGROUND OF THE INVENTION

1. Technical Field

This invention relates to tamper indicating closures for containers such as blow molded plastic bottles which are widely used in the dairy and soft drink industry for the expendible packaging of such products.

2. Description of the Prior Art

Prior closures of this type may be seen in U.S. Pat. Nos. 3,893,583, 4,037,746, 4,066,182 and 4,202,455.

The present invention provides a novel tamper indicating molded plastic closure for a blow molded bottle having a spin finished inturned annular flange defining the opening in the neck portion thereof by providing one or more annular depending flexible sealing flanges formed integrally with the closure and positioned for sealing engagement on the upper surface of the spin finished inturned annular flange of the bottle or the like.

SUMMARY OF THE INVENTION

A snap on tamper indicating closure for containers such as blow molded bottles with spin finished neck configuration takes the form of a cap portion having a resilient top and an annular depending flange on its peripheral edge with an annular tear skirt secured to the depending flange by a frangible wall. Fastening configurations on the inner surfaces of the annular depending flange and the tear skirt are arranged for registry with fastening configurations on the neck portion of the blow molded bottle. Depending flexible annular sealing flanges are integrally molded with the resilient top portion of the cap and positioned for sealing engagement with the upper surface of an inturned annular flange formed on the neck of the bottle by a spin finishing operation to define the opening of the bottle, the spin finished inturned annular flange being distortable to insure the sealing engagement of the depending annular sealing flanges therewith when the tamper indicating closure is positioned on the blow molded bottle.

DESCRIPTION OF THE PREFERRED EMBODIMENT

Figure 4:
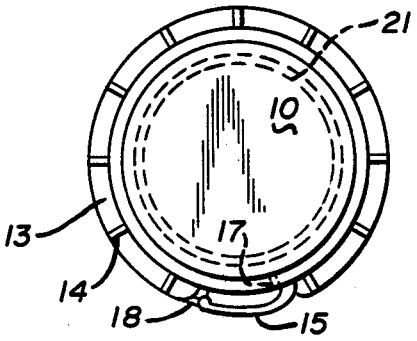
FIG. 4 is a top plan view of the snap on tamper indicating closure showing a pull tab attached to the tear skirt thereof.
Figure 5:
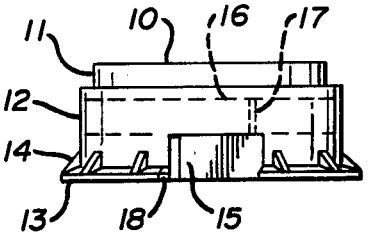
FIG. 5 is a side elevation of the snap on tamper indicating closure showing the pull tab and a tear guide groove in the tear skirt and a plurality of circumferentially spaced gussets on the tear skirt.

By referring to the drawings and FIGS. 4 and 5 in particular, a top plan view and a side elevation of the resilient distortable snap on tamper indicating closure may be seen, the closure including a resilient disc forming a top portion 10 with a depending annular flange 12 having a relatively short first portion 11, the lower edge of the depending annular flange 12 has an outturned angular flange 13 with a plurality of circumferentially spaced gussets 14 positioned thereabout. A pull tab 15 is attached to the depending annular flange 12 in the area between the ends of the outturned angular flange 13. As illustrated in FIG. 5 of the drawings most of the depending annular flange 12, which is of larger diameter than the relatively short first portion 11 thereof, is provided with an annular frangible wall 16 defined by an internal tear groove as best seen in FIGS. 1 and 2 of the drawings.

By referring again to FIG. 5 of the drawings, a vertically disposed tear groove 17 is formed in the inner surface of the depending annular flange 12 of the closure adjacent the end of the pull tab 15 so that freeing the pull tab 15 from its opposite end attachment web 18 permits it to be moved outwardly and when moved to the right as shown in FIGS. 4 and 5 of the drawings, tears the depending annular flange 12 vertically at the tear groove 17 and then annularly in a counter clockwise direction along the frangible wall 16. The majority of the depending annular flange 12 which forms the tear skirt of the device is thus removed and the cap portion of the closure comprising the resilient disc of the top 10 and the short first portion 11 of the depending annular flange 12 remains on the neck of the blow molded bottle in sealing relation thereto.

Figure 1:
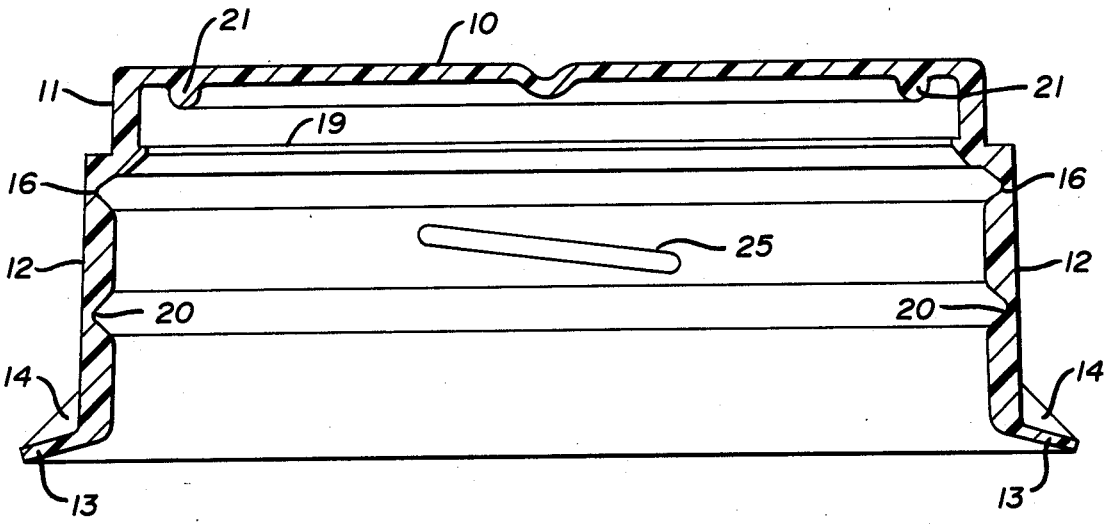
FIG. 1 is a vertical section of the snap on tamper indicating closure.
Figure 2:
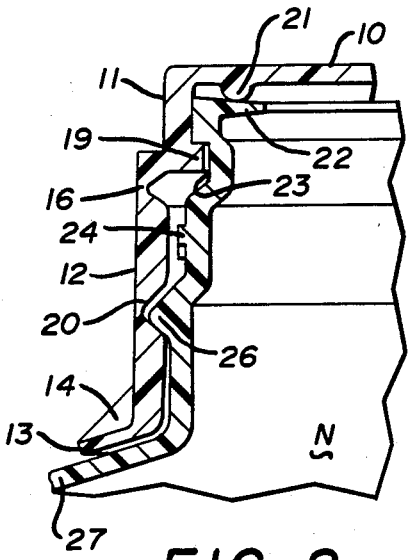
FIG. 2 is a vertical section through a portion of the snap on indicating closure and a portion of a neck of a bottle having an inturned spin finished annular flange on which the closure is applied to effect a positive liquid tight seal.

By referring now to FIGS. 1 and 2 of the drawings, it will be seen that there is an annular inturned short flange 19 on the short first portion 11 of the depending annular flange 12 of the top portion 10 closely spaced above the annular frangible wall 16. There is also an annular groove 20 in the depending annular flange 12 below the annular frangible wall 16. The short annular flange 19 and the annular groove 20 comprise fastening configurations formed in the inner surface of the depending annular flange 12 of the closure.

Still referring to FIG. 1 of the drawings, it will be seen that the top portion 10 of the closure is a resilient disc somewhat thinner than the depending annular flange 12 thereon and has a depending flexible annular sealing flange or bead 21 which with the resilient disc forming the top portion 10 forms a annular flexible seal on a registering portion of a blow molded bottle having a spin finished inturned annular flange 22 defining the opening in the neck portion N of the blow molded bottle.

By referring to FIG. 2 of the drawings, a section of the closure including the complete depending annular flange 12 will be seen positioned in snap on registry with the neck portion of the blow molded bottle, the upper end of the neck portion being defined by the inturned annular flange 22 heretofore referred to. The neck portion has an annular groove 23 inwardly of the upper end of the neck portion and of the bottle in which the inturned short annular flange 19 registers and a plurality of circumferentially spaced short angularly disposed ribs 24, one of which is shown, are formed on the exterior of the neck N of the blow molded bottle therebelow. These short angularly disposed ribs 24 are positioned for registry with a plurality of longer angularly disposed ribs 25, several of which are arranged in circumferentially spaced relation on the inner surface of the depending flange 12 of the closure below the frangible wall 16 therein as best seen in FIG. 1 of the drawings. The ribs 24 and 25 form partial thread patterns so that rotating the closure will disengage it from the neck of the bottle.

Still referring to FIG. 2 of the drawings, it will be seen that the outer surface of the neck N of the bottle has an annular rib 26 formed thereabout below the circumferentially spaced short angularly disposed ribs 24 and positioned for registry with the annular groove 20 in the inner surface of the depending annular flange 12 of the closure.

Still referring to FIG. 2 of the drawings, it will be seen that the bottle on which the neck N is formed has a shoulder configuration 27 which is positioned in close proximity to the lower surface of the angular flange 13 on the depending annular flange 12 of the closure and that the angular flange 13 is held in close proximity to the shoulder 27 of the bottle by the plurality of circumferentially spaced gussets 14.

The closure as illustrated in FIGS. 1, 2, 4 and 5 of the drawings can be quickly and accurately installed on a blow molded bottle having a spin finished neck portion defining the inturned annular flange 22 hereinbefore referred to.

As illustrated herein, the inturned annular flange 22 on the bottle is slightly inclined on top and is preferably somewhat tapered inwardly so as to improve its resilient or deformable characteristics which are generally inherent in the plastic material from which the blow molded bottle is formed, for example high-density polyethylene (HDPE). The inturned annular flange 22 on the bottle is formed by the spin finish operation sometimes locates the actual opening which it defines offcenter of the neck of the bottle and in such instances the heretofore commonly used depending annular flange of the prior art closures fail to sealingly engage the offcenter opening with the resulting failure of the liquid tight seal intended.

In the present invention, the flexible annular sealing flange 21 on the resilient disc of the top 10 of the closure always sealingly engages the upper surface of the inturned annular flange 22 and when irregularities in the upper surface of the inturned annular flange 22 are present, as sometimes occurs, the resiliency of both meeting parts insures a liquid tight seal which is maintained whether or not the opening defined by the inturned annular flange 22 is centrally positioned with respect to the neck of the bottle on which it is formed.

Figure 3:
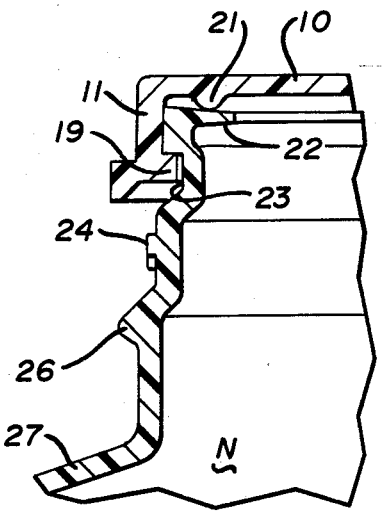
FIG. 3 is a vertical section through a portion of the snap on tamper indicating closure after a tear skirt portion has been removed and showing the same on a portion of the neck of a bottle having a spin finished inturned annular flange on the neck portion thereof.

By referring now to FIG. 3 of the drawings, the cap portion of the closure remaining after the tear skirt portion of the depending annular flange 12 has been removed as hereinbefore described may be seen and it will be observed that the inturned annular flange 19 of the closure is in snap in registry in the annular groove 23 in the neck N of the bottle so that the cap as seen in FIG. 3 is self-retaining and the depending annular sealing flange 21 forms a perfect liquid seal against the inturned annular flange 22 on the neck of the bottle. The snap on tamper indicating closure disclosed herein has the major advantage of being easily applied by fast acting operating machines as commonly used in the industry as the closures are merely positioned loosely on the neck of the bottle and a plunger automatically pushes them down and onto the bottle neck in the double fastening configuration obtained by the registration of the inturned annular flange 19 on the closure with the annular groove 23 in the neck configuration of the bottle and the annular rib 26 on the neck configuration of the bottle registering with the annular groove 20 in the depending annular flange 12 and more particularly in the tear off skirt portion thereof. The ribs 24 and 25 snap over one another when the closure is moved downwardly onto the neck of the bottle.

Figure 6:
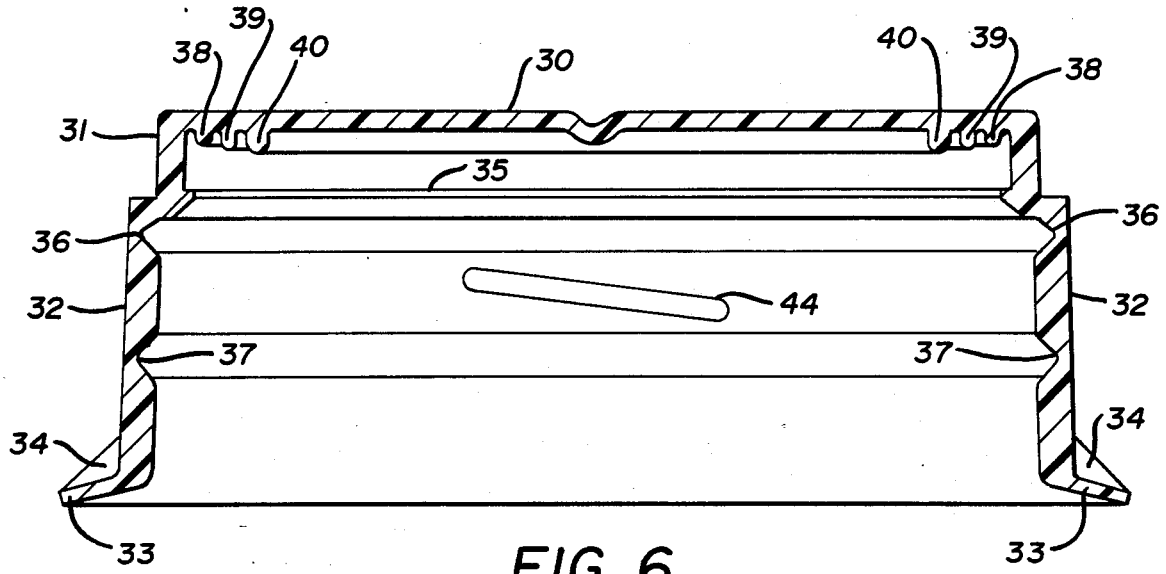
FIG. 6 is a vertical section of a modified closure.
Figure 7:
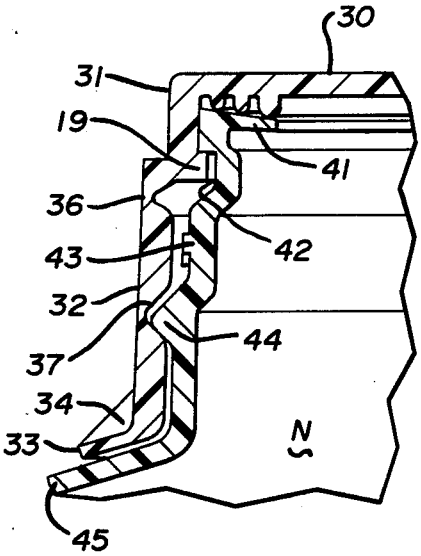
FIG. 7 is a vertical section through a portion of the modified closure and the neck of a bottle.
Figure 8:
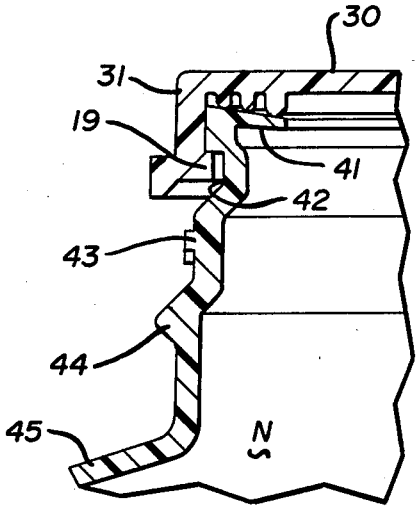
FIG. 8 is a vertical section through a portion of the modified closure positioned on the neck of the bottle with a tear skirt removed.

Modifications of the device disclosed herein may be made as illustrated in FIGS. 6, 7 and 8 of the drawings and by referring thereto it will be seen that the modified tamper indicating closure for containers includes a top portion 30 with a depending annular flange 32 having a short first portion 31; the depending annular flange 32, has an outturned flange 33 with a plurality of circumferentially spaced gussets 34 thereabout. The outturned annular flange 33 has a portion thereof removed as illustrated and heretofore described in connection with FIGS. 4 and 5 of the drawings and a pull tab is attached to the depending annular flange 32 in the area between the ends of the outturned angular flange 33 as disclosed in FIGS. 4 and 5 of the drawings and hereinbefore described.

The modified tamper indicating closure therefore has the same tear skirt feature as the hereinbefore described form of the invention.

Still referring to FIG. 6 of the drawings, it will be seen that there is an annular inturned short flange 35 on the first portion 31 of the depending annular flange 32 of the top portion 30 closely spaced above an annular frangible wall 36. There is also an annular groove 37 in the depending flange 32 below the annular frangible wall 36. The short annular flange 35 and the annular groove 37 comprise fastening configurations formed in the inner surface of the depending annular flange 32 of the modified closure.

Still referring to FIG. 6 of the drawings, it will be seen that the resilient disc forming the top 30 of the closure has several depending flexible annular sealing flanges 38, 39 and 40, which with the resilient disc of the top 30 form a plurality of resilient seals on a registering portion of a blow molded bottle having a spin finished inturned slightly inclined tapered annular flange 41 defining the opening in the neck portion N of the blow molded bottle.

By referring to FIG. 7 of the drawings, a section of the modified closure including the complete depending annular flange 32 will be seen positioned in snap on registry with the neck portion N of the blow molded bottle, the upper end of the neck portion being defined by the inturned annular flange 41 heretofore referred to.

The neck portion has an annular groove 42 inwardly of the upper end thereof in which the inturned short annular flange 35 of the closure registers and a plurality of circumferentially spaced short angularly disposed ribs 43, one of which is shown, are formed on the exterior of the neck N of the blow molded bottle. These short angularly disposed ribs 43 are positioned for registry with a plurality of longer angularly disposed ribs 44 when the closure is rotated, several of which are arranged in circumferentially spaced relation on the inner surface of the depending flange 32 of the modified closure and below the frangible wall 36 therein as seen in FIG. 6 of the drawings.

Still referring to FIG. 7 of the drawings, it will be seen that the outer surface of the neck N of the bottle has an annular rib 44 formed thereabout below the circumferentially spaced short angularly disposed ribs 43 and positioned for registry with the annular groove 37 in the inner surface of the depending annular flange 32 of the modified closure.

It will also be seen that the blow molded bottle on which the neck N is formed has a shoulder configuration 45 positioned in close proximity to the lower surface of the angular flange 33 of the modified closure.

In the modified closure, the depending flexible sealing flanges 38, 39 and 40 which depend from the resilient disc of the top portion 30 of the modified closure are of different diameters and depend from the top portion 30 of the modified closure in different lengths. As illustrated in FIGS. 6, 7 and 8 of the drawings, the sealing flange 38 is closely spaced with respect to the short first portion 31 of the depending annular flange 32 and it depends a relatively short distance below the lower surface of the resilient disc of the top portion 30. It is also the largest dimension wise of the sealing flanges. The sealing flange 39 is spaced inwardly with respect to the sealing flange 38 and it depends from the resilient disc of the top portion 30 a slightly greatly distance than the sealing flange 38. The sealing flange configuration 40 is spaced inwardly with respect to the sealing flange 39 and it depends from the resilient disc of the top portion 30 of the modified closure a slightly greater distance than the sealing flange 39. While three different diameter sealing flanges have been illustrated and described with each of them being of somewhat different depending dimension than the others, it will occur to those skilled in the art that two such positioned and proportioned sealing flanges may be used and under some circumstances, for example when the neck configuration of the blow molded body to be sealed is of a substantially larger diameter more than three sealing flanges may be supplied, each of the sealing flanges being elastic and resilient.

In any event, the flexible sealing registry of the several sealing flanges 38, 39 and 40 is facilitated by the resilient spin finished inturned inclined annular flange 41 of the blow molded bottle neck against which they register when the modified closure is applied thereto.

As illustrated in FIGS. 7 and 8 of the drawings, the sealing flanges 38, 39 and 40 are shown in sealing relation against the inturned annular flanges 41 which have been distorted by such engagement. The sealing flanges 38, 39 and 40 thus form a plurality of annular liquid seals with respect thererto.

In FIG. 7 the complete modified closure with its annular depending flange 32 including the tear skirt portion is shown while in FIG. 8 the tear skirt portion of the annular depending flange 32 has been removed and the top portion 30 of the closure still remains tightly affixed to the neck N of the blow molded bottle with the graduated annular sealing flanges 38, 39 and 40 forming liquid tight multiple seals against the inturned flange 41.

It will thus be seen that the snap on tamper indicating closure for containers disclosed herein has several points of novelty with respect to the closures heretofore known in the art and in particular those which are primarily adapted for use on blow molded plastic bottles such as used in the dairy industry and for the packaging of milk, soft drinks and similar liquid products where specifically the novel features disclosed herein include the dual positive liquid seals obtained by the resilient elastic and distortable engagement of the depending flexible sealing flanges on the resilient disc of the top of the closure and their engagement with the inturned inclined annular flange as formed by the spin finished operation on the neck of the blow molded bottle.

Having thus described my invention, what I claim is:

1. A resilient molded plastic snap on tamper indicating closure and a container, said container including a neck surrounding an opening to the container, the neck defining an inner surface which extends longitudinally of the container, an inturned annular flange which extends radially into the opening and has an outer surface oriented transversely of the neck opening, the flange extending radially into the neck opening beyond the neck inner surface to define an outlet opening which can be off-center with respect to the container neck, and dual closure retaining means on sad neck; said closure comprising means for covering said opening to said container and a depending annular flange surrounding said neck, dual fastening means on said depending annular flange for engaging said retaining means and an annular frangible wall formed in said depending annular flange between said dual fastening means, a score line formed in said depending annular flange extending to said annular frangible wall to define a tear-skirt portion, said tear-skirt portion having a pull tab affixed thereto, said means for covering said opening to said container comprising a resilient disc having said depending annular flange joined thereto at the peripheral edge of said disc, at least one flexible annular sealing bead integrally formed on said resilient disc in depending relation thereto and positioned for sealing engagement with said inturned annular flange outer surface at a location which is radially inward of the innermost surface of said neck whereby an off-center opening is sealingly covered by said closure.

2. The improvement in a snap on tamper indicating closure and a container set forth in claim 1 and wherein one of said dual fastening means on said depending flange is an inturned annular rib and the other is annular groove.

3. The improvement in a snap on tamper indicating closure and a container set forth in claim 1 and wherein said depending annular flange is formed in two diameters, one of which is smaller than the other and is adjacent said means covering said opening and wherein one of said dual fastening means on said depending annular flange positioned for engaging said dual closure retaining means on said neck of said container is located on said smaller diameter of said depending annular flange and the other of said dual fastening means on said depending annular flange is positioned on the larger diameter of said depending annular flange.

4. The improvement in a snap on tamper indicating closure and a container set forth in claim 1 and wherein there are several depending flexible annular sealing beads, each being of a different diameter and spaced with respect to one another and each being of a different depending dimension with respect to one another.

5. The improvement in a snap on tamper indicating closure and a container set forth in claim 1 and wherein there are several depending flexible annular sealing beads of graduated dimensional sizes, the largest of which is closely spaced to said depending annular flange and said depending flexible annular sealing flanges are of graduated depending dimensions greater than their width with the sealing bead having the smallest of said graduated depending dimensions being adjacent said depending annular flange.

6. A resilient molded plastic snap on tamper indicating closure for a container of the type having a neck surrounding an opening to the container defined by an inturned annular flange and having dual closure retaining means on said neck; said closure comprising means for covering said opening to said container and a depending annular flange surrounding said neck, dual fastening means on said depending annular flange for engaging said retaining means and an annular frangible wall formed in said depending annular flange between said dual fastening means, a score line formed in said depending annular flange extending to said annular frangible wall to define a tear-skirt portion, said tear-skirt portion having a pull tab affixed thereto, said means for covering said opening to said container comprising a resilient disc having said depending annular flange joined thereto at the peripheral edge of said disc, at least one flexible annular sealing bead integrally formed on said resilient disc in depending relation thereto and positioned for sealing engagement with said inturned annular flange, and an outturned angular flange joined to said depending annular flange in oppositely disposed relation to said resilient disc and a plurality of gussets positioned in circumferentially spaced relation to one another between said depending annular flange and said outturned angular flange.

* * * * *